US007032351B2

(12) United States Patent
Redman

(10) Patent No.: US 7,032,351 B2
(45) Date of Patent: Apr. 25, 2006

(54) VANDAL RESISTANT BATHROOM PARTITION

(75) Inventor: Dennis Redman, Palmdale, CA (US)

(73) Assignee: Bobrick Washroom Equipment, Inc., North Hollywood, CA (US)

( * ) Notice: Subject to any disclaimer, the term of this patent is extended or adjusted under 35 U.S.C. 154(b) by 0 days.

(21) Appl. No.: 10/288,272

(22) Filed: Nov. 5, 2002

(65) Prior Publication Data

US 2004/0080250 A1 Apr. 29, 2004

Related U.S. Application Data

(60) Provisional application No. 60/421,992, filed on Oct. 28, 2002.

(51) Int. Cl.
*A47K 3/14* (2006.01)

(52) U.S. Cl. ..... 52/34; 52/35; 52/79.1; 4/663; 4/664

(58) Field of Classification Search ..... 4/663, 4/664; 52/27, 79.1, 782.1, 34, 35
See application file for complete search history.

(56) References Cited

U.S. PATENT DOCUMENTS 4,127,905 A * 12/1978 Bowen ..... 52/34
4,503,115 A 3/1985 Hemels et al.
5,275,862 A * 1/1994 Ramadan et al. ..... 428/113
6,247,195 B1 * 6/2001 O'Brien et al. ..... 4/663
6,387,489 B1 5/2002 Willemse et al.
6,652,955 B1 * 11/2003 Plug ..... 428/192 X

FOREIGN PATENT DOCUMENTS

GB 2055410 * 3/1981

* cited by examiner

*Primary Examiner*—Anthony D Barfield
(74) *Attorney, Agent, or Firm*—Christie, Parker & Hale, LLP

(57) ABSTRACT

A bathroom compartment in a bathroom includes at least one partition having a core with one or more core layers, the core layers being made from wood or cellulose fibers which are surrounded and bound by a hot-curing resin. The core includes pigment to provide a solid-core color. The outer surface of the core may be provided without a surface covering or may be covered with a clear sheet of material or a sheet of material having the same color as the solid core color.

31 Claims, 2 Drawing Sheets

VANDAL RESISTANT BATHROOM PARTITION

REFERENCE TO CROSS-RELATED APPLICATIONS

This application claims the benefit of U.S. Provisional Application No. 60/421,992 entitled VANDAL RESISTANT BATHROOM PARTITION, filed on Oct. 28, 2002, the contents of which are incorporated herein by reference.

This invention relates generally to bathroom partitions and, in particular, to improved vandal-resistant bathroom partitions.

BACKGROUND

Commercial and institutional establishments such as office buildings, schools, recreational facilities, convenience stores, etc., provide bathroom facilities, and sometimes shower facilities, for individuals using the establishment. Such facilities may include toilets, urinals, wash basins, showers, and dressing compartments. To provide privacy to individuals using the facilities, partitions are used to form toilet compartments, urinal screens, entrance screens, shower dividers, and dressing compartments.

In high traffic washrooms, such as airports, schools and public stadiums, vandalism can be a problem. Accordingly, washroom partitions in these facilities should have one or more of the following features: easy to clean (including removal of graffiti), resistance to moisture, resistance to dents and impacts, resistance to gouging, carving and chemicals.

Toilet partitions constructed of a solid phenolic core with multiple resin-impregnated kraft and melamine surface sheets are known and provide suitable protection against moisture, graffiti and wear. Such solid phenolic partitions have a durable, hard surface to resist dents and impacts. The surface is also moisture resistance and facilitates removal of marker ink, lipstick and paint without ghosting, using acetone-based cleaners. Known solid phenolic and plastic laminate toilet partitions, installation configurations and other types of bathroom partitions and connections are described on pages 22–30 of the Bobrick Washroom Equipment, Inc. catalog, dated January 2002, incorporated herein by reference.

The exterior surface of solid phenolic panels, however, have a disadvantage in that they can be scratched or gouged with a sharp instrument, revealing a different color below the surface. Repair of the panel, e.g., by painting over the scratch, is usually unsatisfactory because the scratch may still be noticeable. Replacement of the panel is also unsatisfactory due to the expense.

In view of the above, it should be appreciated that there is still a need for a bathroom panel having one or more of the advantages of the solid phenolic panel, but which also provides improved vandal resistance.

SUMMARY

The present invention is embodied in a bathroom partition having one or more of the above-identified advantages of a solid phenolic panel, and also provides improved vandal resistance. The partition has a core with one or more core layers, the core layers being made from a fiber-containing material comprising wood or cellulose fibers which are surrounded and bound by a hot-curing resin. The core also includes pigments to provide a solid core color. The outer surface of the core can be without a surface covering, can be covered with a clear sheet of material, or can be covered with a sheet of material having the same color as the solid core color. Such a partition has the advantage that should the outer surface of the partition be scratched or gouged due to vandalism, the damage is much less noticeable due to the solid core color of the core. If desired, the depth of the gouge can be masked by sanding or buffing the partition to an appropriate depth.

In an alternative embodiment, the partition can also have one or more of the following characteristics: the density of the core is greater than about 900 kg/m$^3$, in particular, between about 900 and 1600 kg/m$^3$; the content of the resin is between at least about 150 g and not more than about 900 g of resin for 1000 g of dry fibers; and the core comprises fibers having lengths from 0.3 to 30 mm.

In another embodiment, the partition has a core with one or more core layers, the core layers being made from a fiber-containing material comprising wood or cellulose fibers which are surrounded and bound by a hot-curing resin. The core includes pigments to provide a solid core color and the outer surface of the core is covered with a clear melamine sheet.

In an alternative embodiment, the core is a multi-layer sheet. Depending on the variation, each layer of the multi-layer sheet has the same solid core color or outer layers of the multi-layer sheet have the same solid core color. Alternatively, the core is a single layer, solid core color sheet.

The partition may be used as a toilet partition, a dressing compartment partition, a shower divider, a urinal screen or an entrance screen.

Other features and advantages of the present invention will become apparent from the following description of the preferred embodiments, taken in conjunction with the accompanying drawings, which illustrate, by way of example, the principles of the invention.

DESCRIPTION OF THE INVENTION

Bathroom partitions having a solid core made from wood fibers and/or cellulose fibers and resin and having a solid core color have improved vandal resistant properties. In one embodiment, a solid core wood fiber and resin panel satisfactorily retains the graffiti-resistant, moisture-resistant, and durability characteristics of solid phenolic panels. In addition, the solid core color throughout the panel allows scratching and gouging due to vandalism to be much less noticeable or to be repaired with the use of either sandpaper or a buffing wheel, without substantially affecting the color of the panel.

It has been discovered that a suitable core for use as a bathroom partition is the fiber-containing core described in U.S. Pat. No. 4,503,115 to Hemels, et al., incorporated by reference herein. In this patent, several embodiments of a fiber-containing core are described which have a density of 900 to 1600 kg/m$^3$, in particular from about 1100 to 1500 kg/m$^3$, and which have a reduced absorption of water.

Preferably, the fiber-containing cores described in the '115 patent are manufactured with a pigment to provide a solid core color to the panel. Examples of such a core containing pigment are described in U.S. Pat. No. 6,387,489 to Willemse, et al., incorporate by reference herein.

Figure 1:
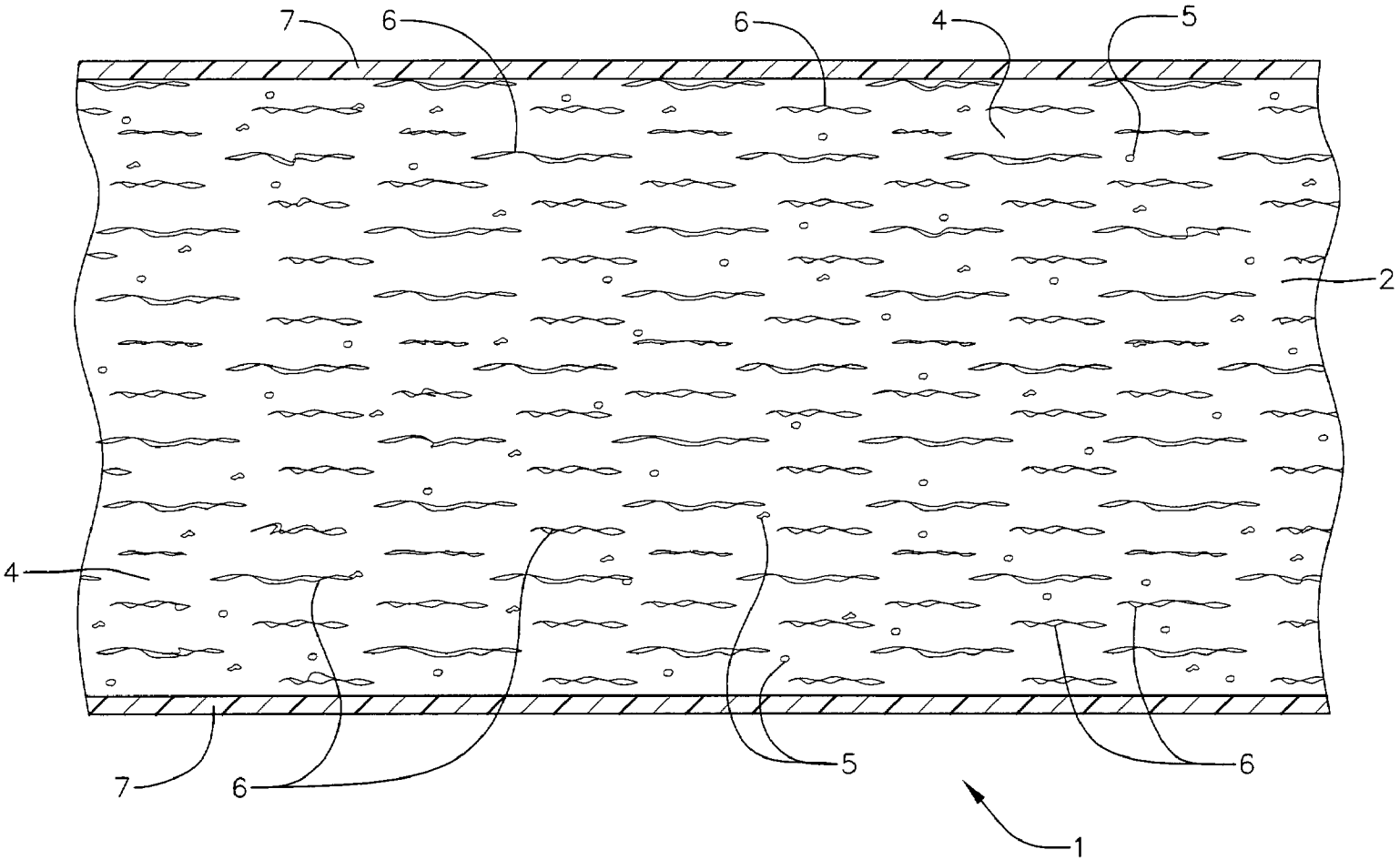
FIG. 1 is a cross-sectional view of a sheet according to the invention having a core or a core layer and covered with a clear sheet of material on an exterior surface and on an interior surface.

With reference to FIG. 1, a bathroom partition according to the invention includes a panel 1 having a core or a core layer 2 made from wood fibers and/or cellulose fibers 6 located in its interior and resin 4 which encloses pigments 5. As mentioned above, U.S. Pat. No. 6,387,489 describes several suitable core layers and their manufacture.

In one embodiment, the core layer 2 is composed of one or more layers made from wood fibers and/or from cellulose fibers 6 and resin 4, the proportion of the fibers being from 50 to 90 percent by weight, in particular 70 percent by weight of the total core weight. The core layer 2 is generally assembled from one to three layers. Cellulose fibers and industrial waste made from wood, paper or cellulose, for example, wood flour or mechanical wood pulp, may be added to the wood fibers. Some of the wood fibers and cellulose fibers, or some of the wood waste, may be replaced by plastic waste in the form of fibers or pellets.

Suitable pigments are titanium dioxide, zinc sulfide, zinc sulfate, red and yellow iron oxide, and quinacridone pigments with violet-red hues. The pigments are generally those selected from the class consisting of the inorganic, colored oxidic pigments, inorganic pigments with hydroxyl groups, inorganic sulfidic pigments, carbon black pigments and quinacridone pigments. The pigments identified above are examples only and are not intended to limit the scope of the invention.

Resins which may be used for coating the cellulose fibers and/or wood fibers, besides hot-curing phenyl formaldehyde resins, are mainly melamine resins or epoxy resins. The proportion of resin is generally from 10 to 50 percent by weight in the mixture made from cellulose fibers and/or wood fibers and from the resin. The proportion of cellulose fibers and/or wood fibers in the mixture may be from 50 to 90 percent by weight.

The density of the sheet 1 is in the range from 1100 to 1500 kg/m$^3$, and the sheets produced have thicknesses of from 2 to 40 mm, in particular from 2 to 20 mm. The hot-curing resin comprises the pigments, but it is also possible to mix the pigments with resin-coated wood fibers and/or cellulose fibers. The proportion of the pigments is generally from about 0 to 20 percent by weight of the weight of the mixture made from pigments and from wood fibers and/or cellulose fibers. The size of the pigments is from 10 mm to 1.5 mm. By choosing different pigments it is possible to achieve different colorings of the core layer 2. In one embodiment, the wood fibers have a length from 0.3 to 30 mm, and average length from 0.5 to 3 mm and an average diameter from 0.025 to 0.05 mm.

Details of the production of the wood fibers for the core layers which are press-molded to form the core are given in U.S. Pat. No. 4,503,115. According to the '115 patent, wood particles with relatively large amounts of thermosetting resins may be densified under high pressure and at high temperatures, so that a panel with a density of from about 900 to 1600 kg/m$^3$, in particular from about 1100 to 1500 kg/m$^3$, is produced which is characterized by a slight absorption of water, excellent dimensional stability and high bending and tensile strength.

The fiber cores described above may be used as bathroom partitions without any further surface covering. Alternatively, the fiber core 2 may be provided with a clear cover layer 7. To improve surface characteristics, clear melamine resins or other suitable materials may be used to give particularly good surface properties to the panel, in particular, in relation to scratching resistance and chemical resistance. Instead of a clear melamine resin layer, a pigmented melamine resin layer may be used, provided the color of the melamine layer matches the solid core color of the core layer.

Figure 2:
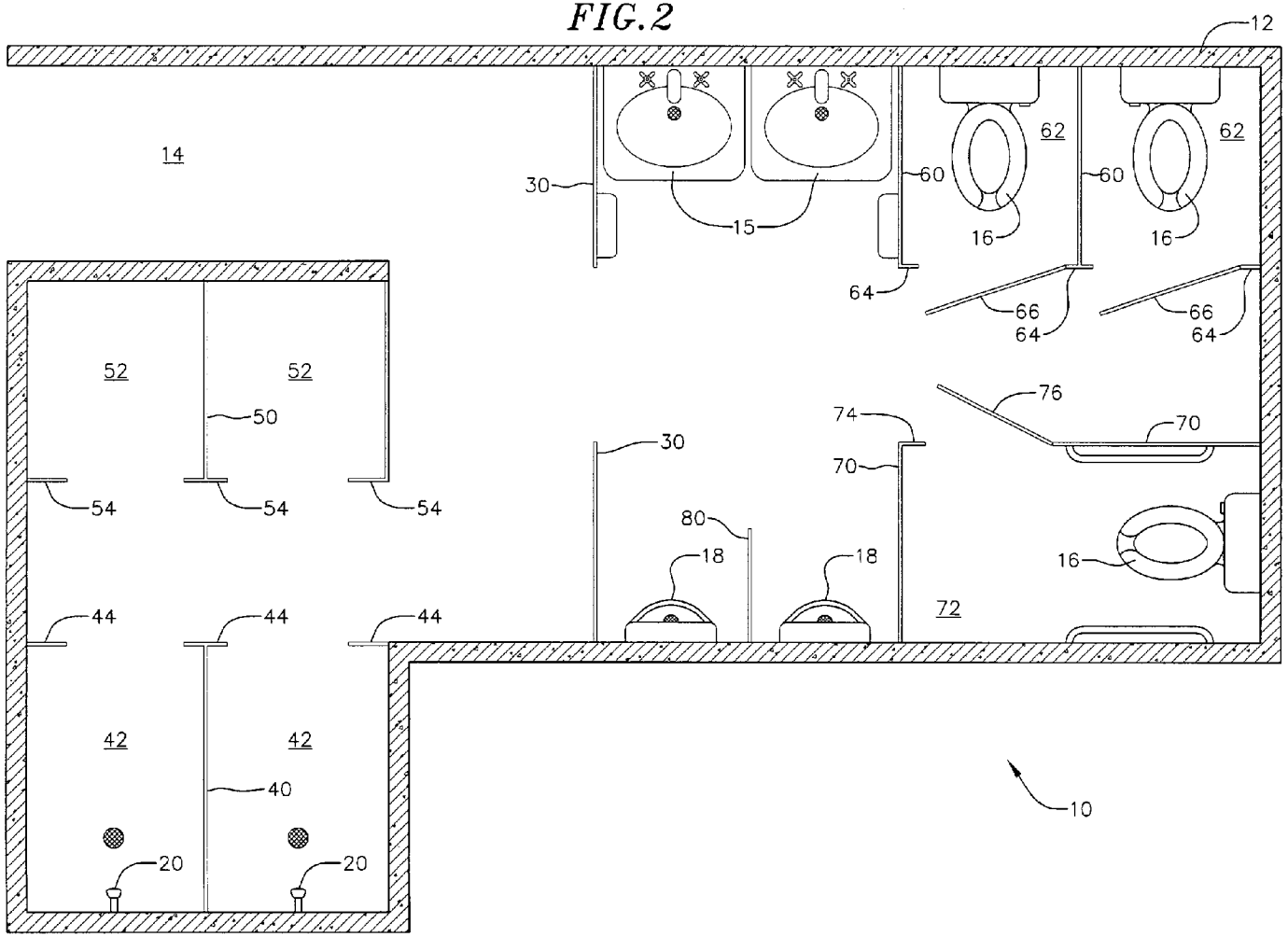
FIG. 2 is a layout of a bathroom using partitions of the invention to form bathroom compartments.

With reference to FIG. 2, a bathroom 10 has a solid block wall 12 and an entryway 14. The bathroom includes two sinks 15, three toilets 16, two urinals 18, and two showerheads 20. The improved vandal-resistant partitions described herein are installed to form suitable compartments or screens.

One partition is an entrance screen 30 placed at the end of the entryway 14. Another entrance screen 30 is placed near the entry to the shower area.

Another partition is a shower divider 40 between the showerheads 20 to form two shower stalls 42. Further partitions, in the form of stiles 44, are located along the front of the shower stalls to define an entry to each shower stall and to support a head rail to hold a shower curtain.

The layout and mounting of partition dividers and stiles are well known in the art and are not detailed herein. The same installation practices and hardware used for solid phenolic panels are suitable for the partitions of the present invention.

Across from the shower stalls, another partition is used as a divider 50 to form two dressing room compartments 52. Further partitions, in the form of stiles 54, are located along a front of the dressing room compartments to define entrances.

Two partitions are used as panel walls 60 to form two toilet compartments 62. Additional stiles 64 are used to hang doors 66 for the toilet compartments. The partitions of the present invention are thus used as panel walls, stiles and doors for bathroom compartments.

Two additional partitions are used as panel walls 70 to form an enlarged toilet compartment 72 providing wheelchair access. A stile 74 and a door 76 complete the compartment.

The partition according to the invention is also used as a urinal screen 80 to separate adjacent urinals.

The partitions in the present invention are impact resistant, have low moisture absorption, are easy to clean and are graffiti resistant. In addition, due to the solid core color, gouges and scratches are not readily noticeable and, if desired, can be removed by buffing or sanding.

It should be appreciated from the foregoing description that the present invention provides an improved vandal resistant bathroom partition.

What is claimed is:

1. A bathroom compartment in a bathroom, comprising:

at least one partition mounted in a bathroom, the partition having two parallel opposed major sides that are exposed to view in the bathroom, each of the two opposed major sides defining a surface area, and at least four perimeter sides around the opposed major sides, each of the at least four perimeter sides defining a smaller surface area than the surface area of each of the two opposed major sides;

the at least one partition having a core with one or more core layers, each of the one or more core layers being made from a fiber containing material comprising wood or cellulose fibers which are surrounded and bound by a resin, the core including pigments to provide a solid core color throughout at least one of the at least one or more core layers;

wherein each of the two opposed major sides comprises a clear sheet of material covering substantially all of the core on respective ones of the two opposed major sides and wherein each of the two opposed major sides are generally uncovered such that substantially all of the core at each opposed major side is exposed to view in the bathroom through the two opposed major sides, respectively.

2. The bathroom compartment of claim 1, wherein the density of the core is greater than about 900 kg/m$^3$.

3. The bathroom compartment of claim 2, wherein the density of the core is between about 900 and 1600 kg/m$^3$.

4. The bathroom compartment of claim 1, wherein the content of the resin is between at least about 150 g and not more than about 900 g of resin per 1000 g of dry fibers.

5. The bathroom compartment of claim 1, wherein the core comprises fibers having lengths from 0.3 to 30 mm.

6. The bathroom compartment of claim 1, wherein the two opposed major sides each comprise a clear melamine sheet.

7. The bathroom compartment of claim 1, wherein the core is a multi-layer sheet.

8. The bathroom compartment of claim 7, wherein each layer of the multi-layer sheet has the same solid core color.

9. The bathroom compartment of claim 7, wherein outer layers of the multi-layer sheet have the same solid core color.

10. The bathroom compartment of claim 1, wherein the core is a single layer, solid core color sheet.

11. The bathroom compartment of claim 1, wherein the partition is one of a toilet partition, a dressing compartment partition, a shower divider, a urinal screen and an entrance screen.

12. The bathroom compartment of claim 1, further comprising a toilet and wherein the partition is a toilet partition in the bathroom.

13. The bathroom compartment of claim 1, further comprising a shower head and wherein the partition is a shower divider in the bathroom.

14. The bathroom compartment of claim 1, further comprising a urinal and wherein the partition is a urinal screen in the bathroom.

15. The bathroom compartment of claim 1, wherein the partition is a stile.

16. The bathroom compartment of claim 1, wherein the partition is a door.

17. A bathroom compartment in a bathroom, comprising:

at least one partition mounted in a bathroom, the partition having two parallel opposed major sides that are exposed to view in the bathroom, each of the two opposed major sides defining a surface area, and at least four perimeter sides around the opposed major sides, each of the at least four perimeter sides defining a smaller surface area than the surface area of each of the two opposed major sides;

the at least one partition having a core with one or more core layers, each of the one or more core layers being made from a fiber containing material comprising wood or cellulose fibers which are surrounded and bound by a resin, the core including pigments to provide a solid core color throughout at least one of the at least one or more core layers;

wherein the two opposed major sides are generally uncovered such that the core is exposed to view in the bathroom at each of the two opposed major sides.

18. The bathroom compartment of claim 1, wherein the density of the core is greater than about 900 kg/m$^3$.

19. The bathroom compartment of claim 18, wherein the density of the core is between about 900 and 1600 kg/m$^3$.

20. The bathroom compartment of claim 1, wherein the content of the resin is between at least about 150 g and not more than about 900 g of resin per 1000 g of dry fibers.

21. The bathroom compartment of claim 1, wherein the core comprises fibers having lengths from 0.3 to 30 mm.

22. The bathroom compartment of claim 1, wherein the core is a multi-layer sheet.

23. The bathroom compartment of claim 1, wherein the core is a single layer, solid core color sheet.

24. A bathroom compartment in a bathroom, comprising:

at least one partition mounted in a bathroom, the partition having two parallel opposed major sides that are exposed to view in the bathroom, each of the two opposed major sides defining a surface area, and at least four perimeter sides around the opposed major sides, each of the at least four perimeter sides defining a smaller surface area than the surface area of each of the two opposed major sides;

the at least one partition having a core with one or more core layers, each of the one or more core layers being made from a fiber containing material comprising wood or cellulose fibers which are surrounded and bound by a resin, the core including pigments to provide a solid core color throughout at least one of the at least one or more core layers;

wherein each of the two opposed major sides comprises a sheet of material covering substantially all of the core on respective ones of the two opposed major sides; and wherein each sheet of material is substantially the same color as a respective outer surface of the core it covers.

25. The bathroom compartment of claim 24, wherein the density of the core is greater than about 900 kg/m$^3$.

26. The bathroom compartment of claim 25, wherein the density of the core is between about 900 and 1600 kg/m$^3$.

27. The bathroom compartment of claim 24, wherein the content of the resin is between at least about 150 g and not more than about 900 g of resin per 1000 g of dry fibers.

28. The bathroom compartment of claim 24, wherein the core comprises fibers having lengths from 0.3 to 30 mm.

29. The bathroom compartment of claim 24, wherein the two opposed major sides each comprise a pigmented melamine sheet.

30. The bathroom compartment of claim 24, wherein the core is a multi-layer sheet.

31. The bathroom compartment of claim 24, wherein the core is a single layer, solid core color sheet.

* * * * *

UNITED STATES PATENT AND TRADEMARK OFFICE

CERTIFICATE OF CORRECTION

PATENT NO. : 7,032,351 B2
APPLICATION NO. : 10/288272
DATED : April 25, 2006
INVENTOR(S) : Dennis Redman It is certified that error appears in the above-identified patent and that said Letters Patent is hereby corrected as shown below:

In the Claims:

| | |
|---|---|
| Column 6, line 7, Claim 18 | Delete "claim 1", Insert -- claim 17 --. |
| Column 6, line 11, Claim 20 | Delete "claim 1", Insert -- claim 17 --. |
| Column 6, line 14, Claim 21 | Delete "claim 1", Insert -- claim 17 --. |
| Column 6, line 16, Claim 22 | Delete "claim 1", Insert -- claim 17 --. |
| Column 6, line 18, Claim 23 | Delete "claim 1", Insert -- claim 17 --. |

Signed and Sealed this

Seventeenth Day of July, 2007

JON W. DUDAS
*Director of the United States Patent and Trademark Office*